US011735408B2

(12) United States Patent
Takahashi

(10) Patent No.: US 11,735,408 B2
(45) Date of Patent: Aug. 22, 2023

(54) ION ANALYZER

(71) Applicant: SHIMADZU CORPORATION, Kyoto (JP)

(72) Inventor: Hidenori Takahashi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 237 days.

(21) Appl. No.: 17/424,210

(22) PCT Filed: Jan. 23, 2019

(86) PCT No.: PCT/JP2019/002069
§ 371 (c)(1),
(2) Date: Jul. 20, 2021

(87) PCT Pub. No.: WO2020/152806
PCT Pub. Date: Jul. 30, 2020

(65) Prior Publication Data

US 2022/0115225 A1 Apr. 14, 2022

(51) Int. Cl.
*H01J 49/14* (2006.01)
*H01J 49/04* (2006.01)

(52) U.S. Cl.
CPC ..... *H01J 49/14* (2013.01); *H01J 49/0422* (2013.01)

(58) Field of Classification Search
CPC ..... H01J 49/14; H01J 49/0422; H01J 49/0045
USPC ..... 250/281, 282, 288
See application file for complete search history.

(56) References Cited

U.S. PATENT DOCUMENTS

2016/0372311 A1* 12/2016 Takahashi ..... G01N 27/623
2020/0111654 A1 4/2020 Takahashi et al.

FOREIGN PATENT DOCUMENTS

WO 2015/133259 A1 9/2015
WO 2018/186286 A1 10/2018

OTHER PUBLICATIONS

International Search Report of PCT/JP2019/002069 dated Apr. 2, 2019 [PCT/ISA/210].
Written Opinion of PCT/JP2019/002069 dated Apr. 2, 2019 [PCT/ISA/237].

* cited by examiner

*Primary Examiner* — Michael Maskell
(74) *Attorney, Agent, or Firm* — Sughrue Mion, PLLC

(57) ABSTRACT

An ion analyzer that generates and analyzes product ions by irradiating precursor ions derived from a sample component with radicals, the ion analyzer including: a reaction chamber (2; 833) into which the precursor ions are introduced; a radical generation unit (5) configured to generate radicals from a first material gas; a metastable particle generation unit (5) configured to generate metastable particles from a second material gas; a radical introduction unit (5) configured to mix the radical and the metastable particles and introduce the mixture into the reaction chamber (2; 833); and an ion detection unit (4; 835) configured to detect product ions generated from the precursor ions by a reaction with the radicals.

10 Claims, 4 Drawing Sheets

ION ANALYZER

CROSS REFERENCE TO RELATED APPLICATIONS

This application is a National Stage of International Application No. PCT/JP2019/002069 filed on Jan. 23, 2019.

TECHNICAL FIELD

The present invention relates to an ion analyzer that generates and analyzes product ions by irradiating precursor ions derived from sample components with radicals.

BACKGROUND ART

In order to identify a polymer compound or analyze its structure, mass spectrometry is widely used in which ions derived from a polymer compound (precursor ions) are dissociated one or more times to generate product ions (also called fragment ions), and the product ions are separated according to the mass-to-charge ratio and detected. One of representative methods for dissociating ions in mass spectrometry, a collision-induced dissociation (CID) method is known in which molecules of an inert gas such as a nitrogen gas are collided with ions. Since, in the CID method, ions are dissociated by the energy given by the collision with an inert molecule, various ions can be dissociated, but selectivity of the position of dissociation, i.e. the position where ions are dissociated, is low. Therefore, the CID method is unsuitable when it is necessary to dissociate ions at a specific site for a structural analysis. For example, in the case of analyzing a peptide or the like, it is desired to specifically dissociate the peptide at the binding position of amino acids. But this is difficult in the CID method.

As an ion dissociation method for specifically dissociating a peptide at a binding position of amino acids, an electron transfer dissociation (ETD) method and an electron capture dissociation (ECD) method have been conventionally used. In the ETD method, a precursor ion is collided with negative ions, and in the ECD method, the precursor ion is irradiated with electrons. These are called unpaired electron-induced dissociation methods, and the N—Cα bond of a peptide main chain is dissociated to generate c/z-series product ions.

In the ETD method and the ECD method, when the precursor ion is a positive ion, the valence of the ion decreases at the time of dissociation. That is, when monovalent positive ions are dissociated, neutral molecules are generated. Therefore, only divalent or higher positive ions can be analyzed. Therefore, the ETD method and the ECD method are not suitable for being combined with the MALDI method that generates many monovalent positive ions.

The present inventor has proposed in Patent Literature 1 a hydrogen-attached dissociation (HAD) method in which unpaired electron-induced dissociation is generated by irradiating peptide-derived precursor ions with hydrogen radicals. In Patent Literature 1, hydrogen radicals generated in a radical generation chamber are injected from a nozzle, and irradiated onto precursor ions trapped in an ion trap. The HAD method is suitable for combination with the MALDI method because the precursor ions are dissociated with the valence unchanged. The c/z-series product ions can also be generated by the HAD method.

The present inventor has also proposed that a peptide-derived precursor ion is specifically dissociated at a binding position of amino acids by using hydroxy radicals, oxygen radicals, or nitrogen radicals. In Patent Literature 2, these radicals are irradiated to precursor ions using the same configuration as that of Patent Literature 1. When the peptide-derived precursor ions are irradiated with these radicals, a/x-series product ions and c/z-series product ions are generated.

CITATION LIST

Patent Literature

Patent Literature 1: WO 2015/133259 A
Patent Literature 2: WO 2018/186286 A

SUMMARY OF INVENTION

Technical Problem

When radicals (for example, hydrogen radicals) generated in the radical generation chamber collide with a wall surface of a pipe that transports the radicals or with a wall surface of a chamber before precursor ions in the ion trap are irradiated with the radicals, temperature of the radicals decreases to near room temperature and adheres to the wall surface. Then, a radical attached to the wall surface is bonded to another radical to become a non-radical (for example, a hydrogen molecule) and disappear. Since the amount of product ions generated by dissociation of precursor ions depends on the amount of radicals irradiated to the precursor ions, if the radicals generated by the radical generation unit disappear before the precursor ions are irradiated, the amount of product ions generated from the precursor ions decreases. Therefore, it is required to reduce the amount of disappearing radicals that have generated in the radical generation unit and to irradiate the precursor ions with more radicals.

Here, the case where product ions generated by dissociating precursor ions by irradiation with radicals are subjected to mass spectrometry has been described as an example, but the same problem as described above also occurs in a case where product ions are separated and measured according to other physical quantities (for example, ion mobility).

The problem to be solved by the invention is to reduce the amount of disappearing radicals and irradiate precursor ions with more radicals in an ion analyzer that generates and analyzes product ions by irradiating precursor ions derived from a sample component with radicals.

Solution to Problem

The invention made to solve the above problems is an ion analyzer that generates and analyzes product ions by irradiating precursor ions derived from a sample component with radicals, the ion analyzer including:

a reaction chamber into which the precursor ions are introduced;

a radical generation unit that generates radicals from a first material gas;

a metastable particle generation unit that generates metastable particles from a second material gas;

a radical introduction unit that mixes the radicals and the metastable particles and introduces the mixture into the reaction chamber; and an ion detection unit that detects product ions generated from the precursor ions by a reaction with the radicals.

Advantageous Effects of Invention

In an ion analyzer according to the invention, radicals generated in a radical generation unit are mixed with metastable particles and introduced into a reaction chamber. A metastable particle is an atom (metastable atom) or a molecule (metastable molecule) in a long-life excited state, and is, for example, a rare gas molecule or an inert gas molecule in an excited state. In the ion analyzer according to the invention, the metastable particles in an excited state and having a large internal energy collide with radicals collided with and attached to a wall surface of a pipe, a chamber, or the like during transportation from the radical generation unit to the reaction chamber, and the radicals are released from the wall surface. Therefore, it is possible to reduce the number of radicals generated in the radical generation chamber from being bonded to other radicals to disappear, and to introduce more radicals into the reaction chamber and irradiate the precursor ions.

DESCRIPTION OF EMBODIMENTS

An embodiment of an ion analyzer according to the invention will be described below with reference to the drawings. The ion analyzer of a first embodiment is an ion trap-time-of-flight (IT-TOF type) mass spectrometer.

Figure 1:
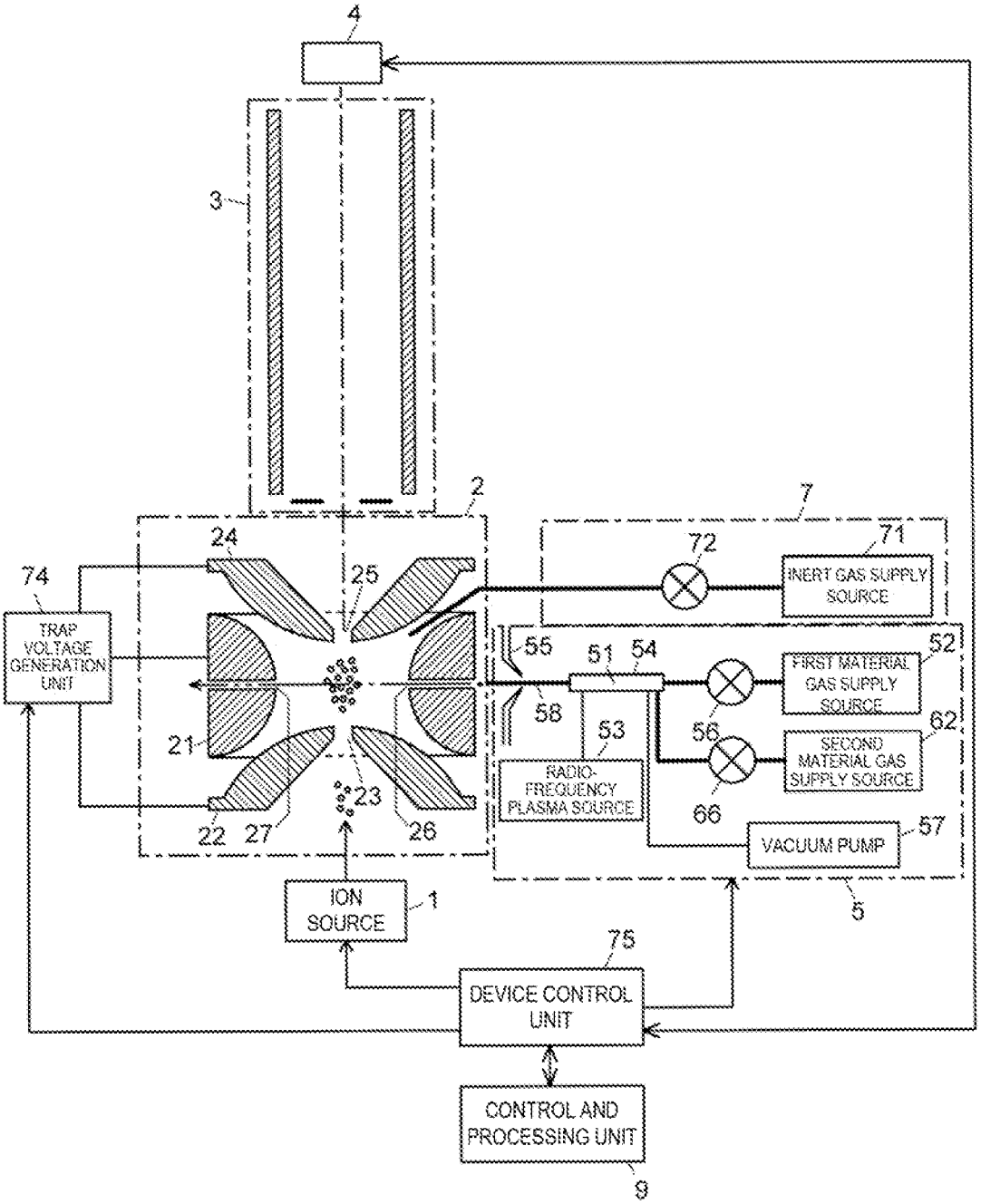
FIG. 1 is a schematic configuration diagram of an ion trap-time-of-flight mass spectrometer that is a first embodiment of an ion analyzer according to the invention.

FIG. 1 illustrates a schematic configuration of an ion trap-time-of-flight mass spectrometer (hereinafter, also simply referred to as "mass spectrometer") of the first embodiment. The mass spectrometer of the first embodiment, inside a vacuum chamber (not illustrated) maintained in a vacuum atmosphere, includes an ion source 1 for ionizing components in a sample, an ion trap 2 for trapping ions generated by the ion source 1 by a radio-frequency electric field, a time-of-flight mass separation unit 3 for separating ions ejected from the ion trap 2 according to their mass-to-charge ratios, and an ion detector 4 for detecting the separated ions. The ion trap mass spectrometer of the first embodiment further includes a radical generation/irradiation unit 5 for irradiating the precursor ions trapped in the ion trap 2 with radicals in order to dissociate the ions trapped in the ion trap 2, an inert gas supply unit 7, a trap voltage generation unit 74, a device control unit 75, and a control and processing unit 9. In the first embodiment, a radical generation unit, a metastable particle generation unit, and a radical introduction unit according to the invention are configured as the radical generation/irradiation unit 5.

As the ion source 1 of the mass spectrometer of the first embodiment, an ion source suitable for ionization of sample components, such as an ESI source or a MALDI ion source, is used. The ion trap 2 of the first embodiment is a three-dimensional ion trap which includes an annular ring electrode 21, and a pair of end cap electrodes (an inlet-side end cap electrode 22 and an outlet-side end cap electrode 24) that are opposed to each other with the ring electrode 21 interposed therebetween. A radical particle introduction port 26 and a radical particle discharge port 27 are formed in the ring electrode 21. An ion introduction hole 23 is formed in the inlet-side end cap electrode 22. An ion ejection hole 25 is formed in the outlet-side end cap electrode 24. In response to an instruction from the device control unit 75, the trap voltage generation unit 74 applies a radio-frequency voltage, a direct-current voltage, or a combined voltage thereof to each of the ring electrode 21, the inlet-side end cap electrode 22, and the outlet-side end cap electrode 24 at a predetermined timing.

The radical generation/irradiation unit 5 includes a nozzle 54 in which a radical generation chamber 51 is formed, a vacuum pump (vacuum exhaust unit) 57 that exhausts the radical generation chamber 51, and an inductively coupled radio-frequency plasma source 53 that supplies microwaves for generating vacuum discharge in the radical generation chamber 51. A transport pipe 58 for transporting radicals generated in the radical generation chamber 51 to the reaction chamber is connected to an outlet end of the nozzle 54. The transport pipe 58 in the first embodiment is a pipe made of quartz (insulating pipe), and a plurality of types of quartz pipes (for example, four types of inner diameters: 5 mm, 1 mm, 500 μm, and 100 μm) having different inner diameters are prepared. These are used depending on the amount of radicals to be irradiated and the degree of vacuum in the ion trap 2. When the inner diameter is larger than 5 mm, the amount of gas flowing into the ion trap 2 through the transport pipe 58 increases, and it is difficult to maintain ultrahigh vacuum in the ion trap 2. On the other hand, when the inner diameter is less than 100 μm, the amount of radicals irradiated to the precursor ions may be insufficient.

In addition, the radical generation/irradiation unit 5 includes a first material gas supply source 52 that supplies a gas (first material gas) as a material of radicals and a second material gas supply source 62 that supplies an inert gas (second material gas) as a material of metastable atoms and metastable molecules. Valves 56 and 66 for adjusting the flow rates of the respective material gases are provided in the flow path for supplying the material gas from the first material gas supply source 52 to the radical generation chamber 51 and in the flow path for supplying the inert gas from the second material gas supply source 62 to the radical generation chamber 51.

As the first material gas, for example, water vapor (water) or air can be used. When water vapor is used as the first material gas, hydroxyl radicals, oxygen radicals, and hydrogen radicals are generated. When air is used, oxygen radicals and nitrogen radicals are mainly generated. As the second material gas, for example, a nitrogen gas and various rare gases are used. As the second gas, it is preferable to use a gas of a type that can excite the radical generated in the radical generation chamber 51 to an excited state having a lifetime equal to or longer than the time required to transport the radical to the ion trap 2. For example, when helium gas is used, helium atoms in the metastable state of the $2^3S$ state (triplet state in which electrons are in the 1 s orbital and the 2 s orbital) having an extremely long life of $10^3$ to $10^4$ seconds can be generated.

Figure 2:
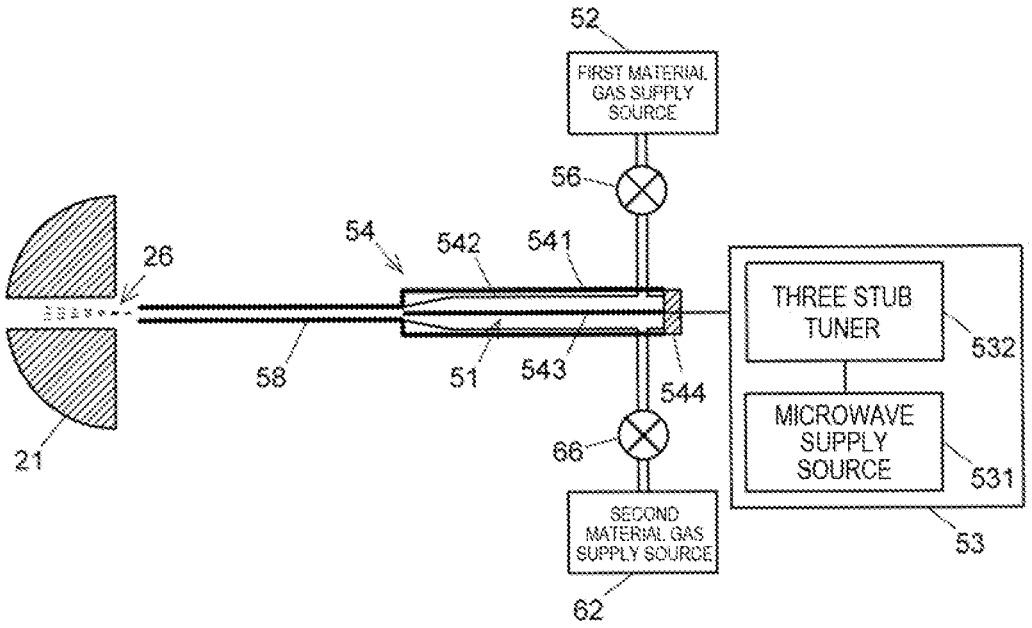
FIG. 2 is a schematic configuration diagram of a radical generation/irradiation unit used in the ion trap-time-of-flight mass spectrometer of the first embodiment.

As illustrated in FIG. 2, the radio-frequency plasma source 53 includes a microwave supply source 531 and a three stub tuner 532. The nozzle 54 includes a ground electrode 541 constituting an outer peripheral portion and a torch 542 made of Pyrex (registered trademark) glass located inside the ground electrode, and the inside of the torch 542 serves as the radical generation chamber 51. Inside the radical generation chamber 51, a needle electrode 543 connected to the radio-frequency plasma source 53 via a connector 544 penetrates in the longitudinal direction of the radical generation chamber 51.

Next, an analysis operation in the mass spectrometer of the first embodiment will be described. Before starting analysis, the inside of the vacuum chamber and the radical generation chamber 51 is evacuated to a predetermined vacuum degree by a vacuum pump. Subsequently, the first material gas is supplied from the first material gas supply source 52, and the second material gas is supplied from the second material gas supply source 62 to the radical generation chamber 51 of the radical generation/irradiation unit 5. When a microwave is supplied from the radio-frequency plasma source 53, radicals and metastable particles (metastable atoms or metastable molecules) are simultaneously generated inside the radical generation chamber 51.

Various ions (mainly monovalent ions) generated from a sample such as a peptide mixture in the ion source 1 are ejected from the ion source 1 in a packet shape and introduced into the ion trap 2 through the ion introduction hole 23 formed in the inlet-side end cap electrode 22. The peptide-derived ions introduced into the ion trap 2 are trapped by the radio-frequency electric field formed in the ion trap 2 by the voltage applied from the trap voltage generation unit 74 to the ring electrode 21. Thereafter, a predetermined voltage is applied from the trap voltage generation unit 74 to the ring electrode 21 and the like, whereby ions included in a mass-to-charge ratio range other than ions having a target specific mass-to-charge ratio are excited and excluded from the ion trap 2. As a result, precursor ions having a specific mass-to-charge ratio are selectively trapped in the ion trap 2.

Subsequently, the valve 72 of the inert gas supply unit 7 is opened, and an inert gas such as helium gas is introduced into the ion trap 2 from an inert gas supply source 71. As a result, the precursor ions are cooled and converged to the vicinity of the center of the ion trap 2. Thereafter, the valves 56 and 66 of the radical generation/irradiation unit 5 are opened, and the mixture of the radicals generated in the radical generation chamber 51 and the metastable particles is ejected from the distal end of the transport pipe 58, and the precursor ions trapped in the ion trap 2 are irradiated with the mixture.

The degrees of opening and the like of the valves 56 and 66 are kept constant, and ions are irradiated with radicals at a predetermined flow rate. The irradiation time of the radicals to the precursor ions is also set appropriately. The degrees of opening of the valves 56 and 66, the time for starting and stopping the supply of the microwave can be determined according to the irradiation time in advance based on the result of the preliminary experiment and the like. When the radicals are irradiated, unpaired electron-induced dissociation occurs in the precursor ions to generate peptide-derived product ions. The various product ions generated are trapped in the ion trap 2 and cooled by helium gas or the like supplied from the inert gas supply unit 7. After that, a high DC voltage is applied from the trap voltage generation unit 74 to the inlet-side end cap electrode 22 and the outlet-side end cap electrode 24 at a predetermined timing, whereby the ions trapped in the ion trap 2 receive acceleration energy and are simultaneously ejected through the ion ejection holes 25. The product ions generated here may include both fragment ions and adduct ions.

In this way, the product ions having constant acceleration energy are introduced into a flight space of the time-of-flight mass separation unit 3, and are separated according to their mass-to-charge ratios while flying in the flight space. The ion detector 4 sequentially detects the separated ions, and the control and processing unit 9 that has received the detection signal creates a time-of-flight spectrum in which the time of emission of the ions from the ion trap 2 is set to zero, for example. Then, the flight time is converted into a mass-to-charge ratio using mass calibration information obtained in advance, and a product ion spectrum is created. The control and processing unit 9 identifies components (peptides) in the sample by performing predetermined data processing based on information (mass information) obtained from the mass spectrum. The partial structure of the peptide can be determined from the mass-to-charge ratio of fragment ions among product ions. For example, when the sample component is a peptide, the presence or the like of a site having a certain characteristic included in the peptide can be seen from the specificity of the adduct material of the adduct ions. For example, it is known that oxygen easily adheres to methionine and aromatic amino acids, and information such as the number of methionine and aromatic amino acids contained in the peptide can be obtained from an adduct ion to which oxygen is added.

The pressure in the radical generation chamber 51 of the radical generation/irradiation unit 5 is about 0.01 to 1 Pa. On the other hand, the inside of the ion trap 2 is usually maintained at an ultrahigh vacuum of about $10^{-3}$ Pa. In order to maintain a pressure difference between the two, a skimmer 55 is provided between the both. In the conventional ion analyzer, the radicals generated in the radical generation chamber 51 are injected from the distal end of the nozzle 54 to irradiate the precursor ions in the ion trap 2. Therefore, among the radicals injected from the distal end of the nozzle 54, only the radicals traveling straight toward the top of the skimmer 55 are introduced into the ion trap 2, and the irradiation efficiency of the radicals to the precursor ions is poor.

Even in the conventional ion analyzer, it is possible to transport radicals by attaching a transport pipe having a small diameter to the distal end of the nozzle. However, a part of the radicals adheres to the inner wall surface while passing through the transport pipe, and reacts with another radical to be non-radicalized and disappear. Therefore, even if a transport pipe is used in a conventional ion analyzer, the irradiation efficiency of radicals to precursor ions is not improved.

On the other hand, in the ion analyzer of the first embodiment, radicals generated in the radical generation chamber 51 are introduced into the ion trap 2 through the transport pipe 58 attached to the distal end of the nozzle 54. In addition, not only radicals but also metastable particles are mixed and transported to the ion trap 2. The metastable particles are atoms (metastable atoms) or molecules (metastable molecules) in a long-life excited state, and these have larger internal energy than atoms and molecules in a ground state. By introducing the radicals generated in the radical generation chamber 51 into the transport pipe 58 together with the metastable particles as in the first embodiment, even if a part of the radicals adheres to the inner wall surface of the transport pipe 58, the radicals can be released from the wall surface by the metastable particles. In addition, there is also a mechanism by which the metastable particles generate new radical species in the transport pipe 58. Therefore, the amount of disappearing radicals is reduced as compared with the conventional case, and the irradiation efficiency of radicals to precursor ions is improved. In the first embodiment, the distal end of the transport pipe 58 is inserted through the opening at the top of the skimmer 55 and disposed in the vicinity of the radical particle introduction port 26 formed in the ring electrode 21, but the distal end of the transport pipe 58 may be inserted into the radical particle introduction port 26.

Next, a result of an experiment conducted by the present inventor in which precursor ions (molecular ions) derived from fullerene trapped in the ion trap 2 are irradiated with radicals and the generated product ions are mass-separated and detected will be described. In this experiment, water vapor was used as the first material gas (material gas of radicals), and helium and nitrogen were used as the second material gas (material gas of metastable particles).

Figure 3:
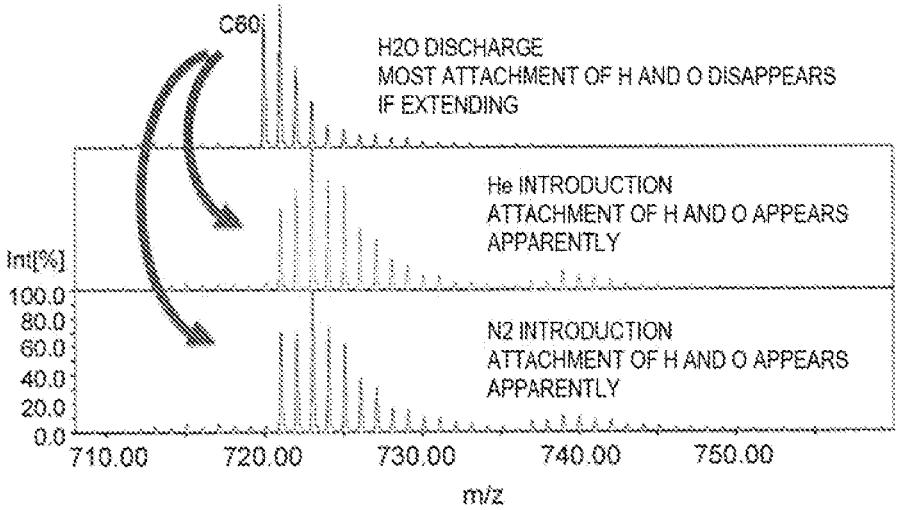
FIG. 3 is a diagram for explaining a result of irradiating fullerene with hydrogen radicals together with metastable atoms and metastable molecules in the mass spectrometer of the first embodiment.

The upper part of FIG. 3 shows a result of irradiating only radicals to precursor ions in a conventional manner, the middle part shows a result of using helium as a second material gas and mixing helium atoms in a metastable state with radicals to irradiate the precursor ions, and the lower part shows a result of using nitrogen gas as a second material gas and mixing nitrogen molecules in a metastable state with radicals to irradiate the precursor ions. The radical addition reaction of fullerene is an exothermic reaction. That is, since the energy threshold of the radical addition reaction is 0 and all the radicals irradiated to the precursor ions derived from fullerene adhere, the amount of radicals irradiated to the precursor ions can be estimated by this experiment. In any measurement, the transport pipe 58 (quartz tube having an inner diameter of 3 mm and a length of 50 mm) was used at the distal end of the nozzle 54.

Compared with the spectrum in the upper part of FIG. 3, more peaks of radical-attached ions can be confirmed in the spectra in the middle and lower parts. That is, by adopting the configuration of the first embodiment in which radicals are transported to the ion trap 2 together with metastable particles generated from helium gas or nitrogen gas, it is possible to irradiate precursor ions with more radicals. In this experiment, since water vapor was used as the first material gas, it is considered that hydrogen radicals, oxygen radicals, and hydroxy radicals were generated and adhered to the precursor ions.

Figure 4:
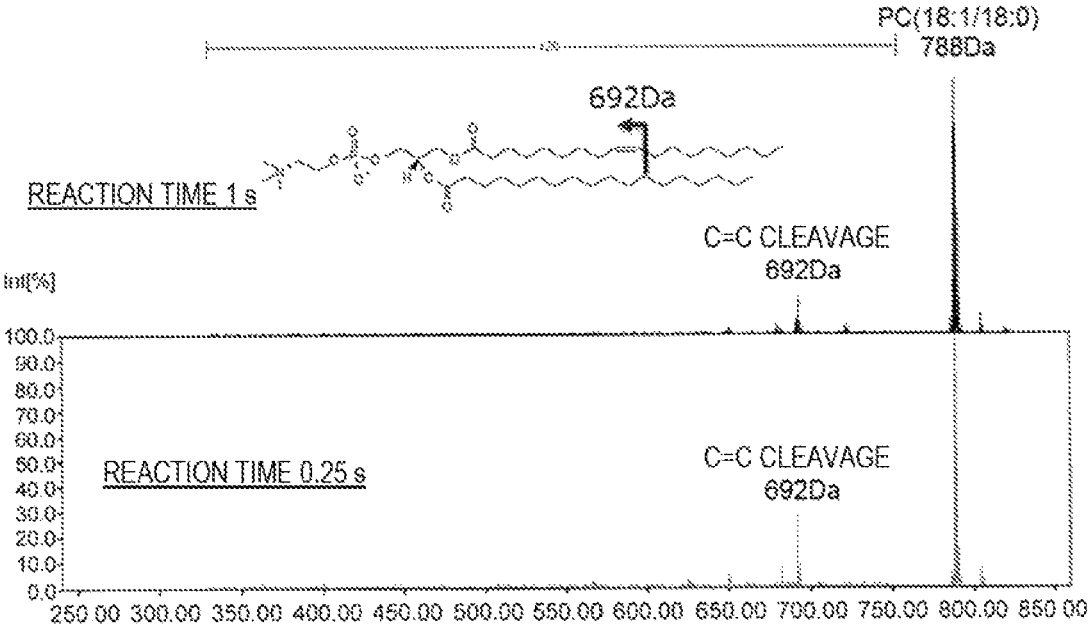
FIG. 4 is a diagram for explaining a result of irradiating a phospholipid with oxygen radicals together with metastable atoms and metastable molecules in the mass spectrometer of the first embodiment.

FIG. 4 shows the results of irradiating oxygen radicals to precursor ions derived from phospholipids (PC (18:0/18:1)) using the technique proposed by the present inventor in the previous application (PCT/JP2018/043074) in which a substance having an unsaturated bond is irradiated with a radical having oxidizing ability to specifically dissociate the precursor ions at the position of the unsaturated bond. The upper part of FIG. 4 illustrates a product ion spectrum obtained by injecting only oxygen radicals from the nozzle 54 for 1 second and introducing the oxygen radicals into the ion trap 2 through the opening of the skimmer 55, similarly to the conventional ion analyzer. The lower part of FIG. 4 illustrates a product ion spectrum obtained by the configuration of the first embodiment, that is, by mixing oxygen radicals and nitrogen molecules in a metastable state and introducing the mixture into the ion trap 2 through the transport pipe 58 for 0.25 seconds. By using the ion analyzer of the first embodiment, product ions of the same amount as that of the conventional one are obtained with the conventional radical irradiation time of ¼. That is, by using the ion analyzer of the first embodiment, it is possible to irradiate the precursor ions with radicals with high efficiency of about four times that of the conventional ion analyzer.

The first embodiment is an ion analyzer including a three-dimensional ion trap, but the radical generation/irradiation unit 5 using a transport pipe can also be used for an ion analyzer including a linear ion trap in the same manner as described above. A triple quadrupole mass spectrometer as an example thereof will be described with reference to FIGS. 5 and 6.

Figure 5:
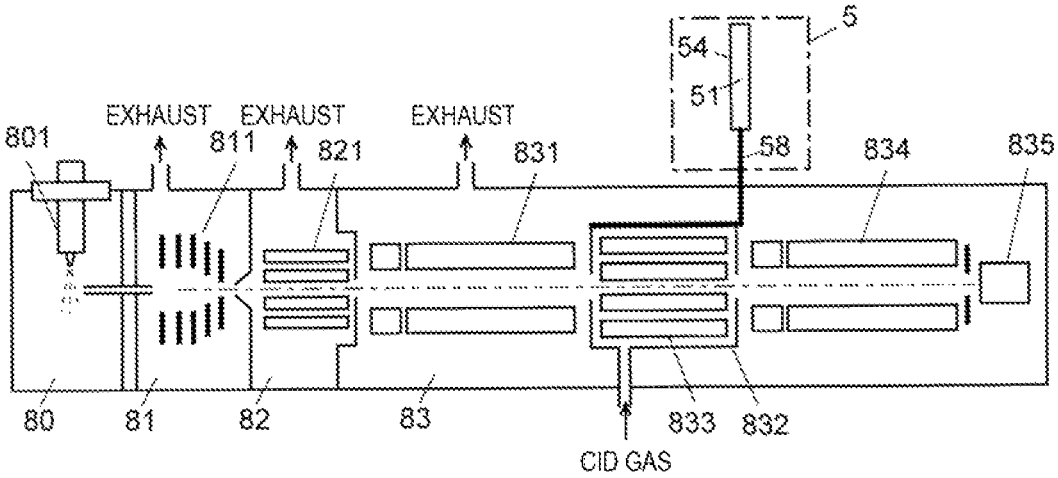
FIG. 5 is a schematic configuration diagram of a triple quadrupole mass spectrometer as a second embodiment of the ion analyzer according to the invention.

FIG. 5 is a schematic configuration diagram of a mass spectrometer of a second embodiment (the device control unit 75 and the control and processing unit 9 are not illustrated). The mass spectrometer of the second embodiment has a configuration of a multi-stage differential exhaust system including a first intermediate vacuum chamber 81 and a second intermediate vacuum chamber 82 in which the degree of vacuum is increased stepwise between an ionization chamber 80 at substantially atmospheric pressure and a high-vacuum analysis chamber 83 evacuated by a vacuum pump (not illustrated). In the ionization chamber 80, for example, an ESI probe 801 is installed. In order to transport the ions to the subsequent stage while converging the ions, an ion guide 811 is installed in the first intermediate vacuum chamber 81, and an ion guide 821 is installed in the second intermediate vacuum chamber 82. In the analysis chamber 83, a front-stage quadrupole mass filter 831 that separates ions according to their mass-to-charge ratios, a collision cell 832 in which a multipole ion guide 833 is installed, a rear-stage quadrupole mass filter 834 that separates ions according to their mass-to-charge ratios, and an ion detector 835 are installed.

The radical generation/irradiation unit 5 has the same configuration as that of the first embodiment (FIG. 5 illustrates only the radical generation chamber 51, the nozzle 54, and the transport pipe 58 of the radical generation/irradiation unit 5). The transport pipe 58 is disposed such that a distal end portion of the transport pipe 58 is along a wall surface of the collision cell 832.

Figure 6:
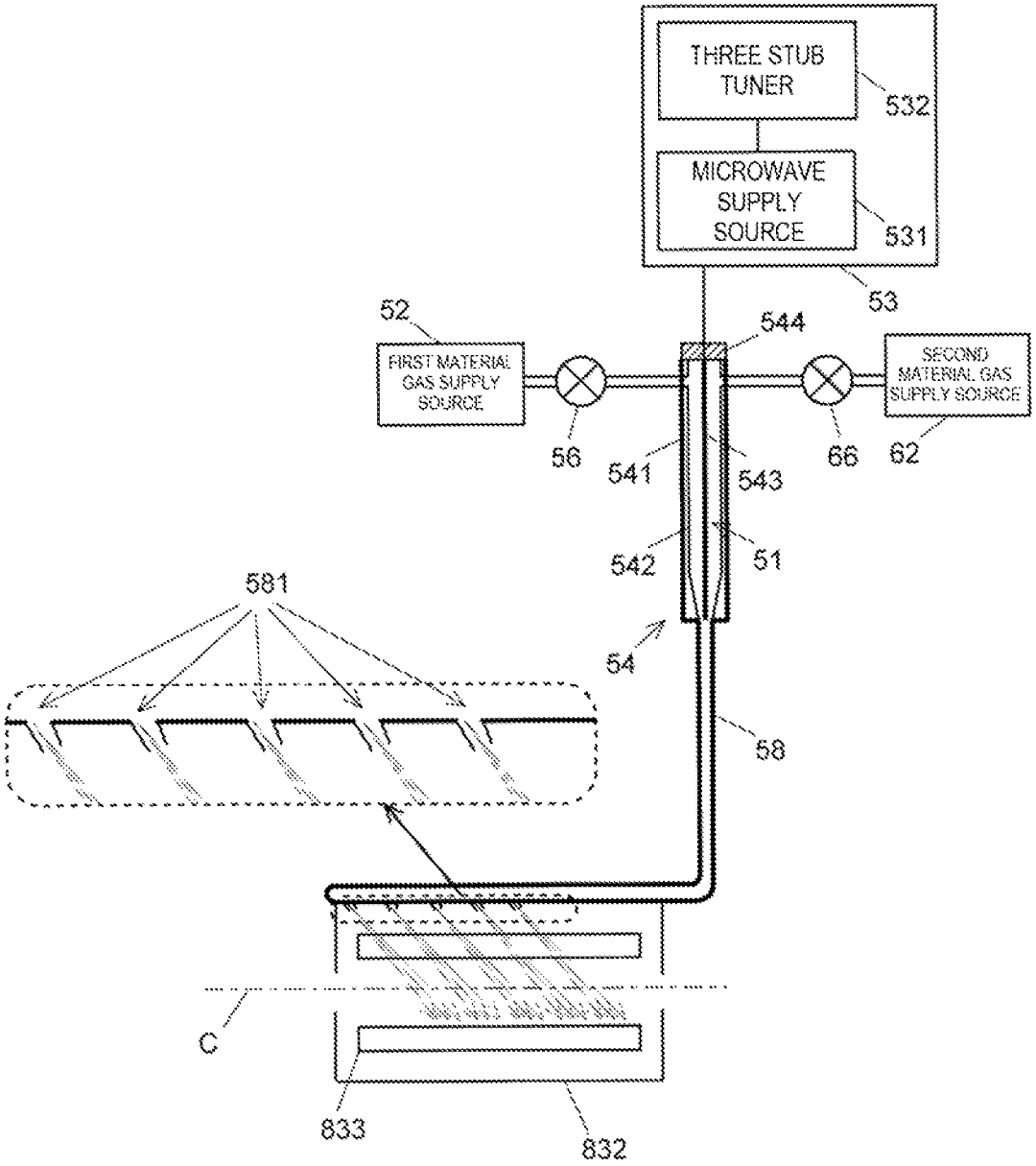
FIG. 6 is a schematic configuration diagram of a radical generation/irradiation unit used in the triple quadrupole mass spectrometer according to the second embodiment.

As illustrated in FIG. 6, five head parts 581 are provided in a portion of the transport pipe 58 disposed along the wall surface of the collision cell 832. Each head part 581 is provided with an inclined cone-shaped injection port, and radicals are injected in a direction intersecting the flight direction of ions (ion optical axis C). This increases the chance of contact between ions flying along the ion optical axis C and radicals, and more radicals can be attached to the precursor ions. In this example, the injection port is provided so as to inject radicals in the same direction from each head part 581, but radicals may be injected in different directions from each head part 581, and the radicals may be evenly injected into the entire internal space of the collision cell 832.

Also in the second embodiment, similarly to the first embodiment, since radicals and metastable particles are mixed and introduced into the linear ion trap 832, precursor ions derived from sample components can be irradiated with radicals with high efficiency.

Each of the above embodiments is an example, and can be appropriately changed in accordance with the gist of the present invention.

In the first and second embodiments described above, the radical generation/irradiation unit 5 including the radio-frequency plasma source 53 is used, and both radicals and metastable particles are generated in the radical generation/ irradiation unit 5. However, the radical generation unit and the metastable particle generation unit may be separately provided. In this case, various combinations can be adopted, for example, a hollow cathode plasma source is used for the radical generation unit, and for example, a configuration in which the second material gas is irradiated with light of a predetermined wavelength to excite gas molecules is used for the metastable particle generation unit. In a case where the second material gas (the material gas of the metastable particles) and the inert gas (the gas for cooling the precursor ions) are the same type of gas (for example, nitrogen gas), it is possible to supply the cooling gas to the ion trap 2 and supply the second material gas to the radical generation chamber (metastable particle generation chamber) 41 by, for example, branching a flow path from one gas supply source into two and providing a flow path switching unit in the branching portion. When the first material gas and the second material gas are the same type of gas (for example, nitrogen gas), both radicals and metastable particles can be generated from the gas by using the radical generation/irradiation unit 5 including the radio-frequency plasma source 53 as in the ion analyzer of the first and second embodiments.

In the first embodiment, the time-of-flight mass separation unit is a linear type, but a time-of-flight mass separation unit such as a reflectron type or a multi-turn type may be used. In addition to the time-of-flight mass separation unit, other forms of mass separation unit such as a mass separation unit that uses an ion separation function of the ion trap 2 itself or an orbitrap can be used. The radical generation/irradiation unit 5 described in the first and second embodiments can be suitably used not only in a mass spectrometer but also in an ion mobility analyzer.

Various embodiments of the invention have been described in detail with reference to the drawings. Finally, various aspects of the invention will be described.

An ion analyzer according to a first aspect of the invention is an ion analyzer that generates and analyzes product ions by irradiating precursor ions derived from a sample component with radicals, the ion analyzer including:

a reaction chamber into which the precursor ions are introduced;

a radical generation unit that generates radicals from a first material gas;

a metastable particle generation unit that generates metastable particles from a second material gas;

a radical introduction unit that mixes the radical and the metastable particles and introduces the mixture into the reaction chamber; and an ion detection unit that detects product ions generated from the precursor ions by a reaction with the radicals.

In the ion analyzer of the first aspect the radicals generated in the radical generation unit are mixed with metastable particles and introduced into the reaction chamber. In the ion analyzer of the first aspect, the metastable particles in an excited state and having a large internal energy collide with radicals attached by collision with a wall surface of a pipe, a chamber, or the like during transportation from the radical generation unit to the reaction chamber, and the radicals are separated from the wall surface. Therefore, it is possible to reduce the number of radicals generated in the radical generation chamber from being bonded to other radicals to disappear, and to introduce more radicals into the reaction chamber and irradiate the precursor ions.

In an ion analyzer according to a second aspect of the invention, in the ion analyzer according to the first aspect, the second material gas is a rare gas or a nitrogen gas.

In the ion analyzer of the second aspect, metastable particles are generated using a rare gas or a nitrogen gas. Metastable particles generated from a rare gas or a nitrogen gas generally have a long life, and therefore can be transported to the reaction chamber with high efficiency while reducing the amount of disappearing radicals.

In an ion analyzer according to a third aspect of the invention, in the ion analyzer according to the first or second aspect, the radical introduction unit includes a transport pipe that transports a mixture of the metastable particles and the radicals to the reaction chamber.

In the ion analyzer of the third aspect, since the mixture of the radical and the metastable particles is transported to the reaction chamber through the transport pipe, the loss due to the diffusion of the radical can be reduced, and the mixture can be transported to the reaction chamber with higher efficiency.

An ion analyzer according to a fourth aspect of the invention is the ion analyzer according to the third aspect, wherein the transport pipe has an inner diameter of 5 mm or less.

In the ion analyzer of the fourth aspect, since radicals are transported to the reaction chamber by the transport pipe having an inner diameter of 5 mm or less, it is possible to prevent excessive gas from flowing into the reaction chamber and to maintain high vacuum in the reaction chamber.

An ion analyzer according to a fifth aspect of the invention is the ion analyzer according to the third or fourth aspect, wherein the transport pipe is an insulating pipe.

In the ion analyzer of the fifth aspect, as the insulating pipe, for example, an insulating pipe made of alumina can be used. In the ion analyzer of the fifth aspect, since the transport pipe including the insulating pipe is used, it is known that the introduction efficiency of microwave power into plasma can be improved as compared with the quartz pipe due to the difference in dielectric constant, and power consumption can be reduced.

An ion analyzer according to a sixth aspect of the invention is the ion analyzer according to any one of the third to fifth aspects, wherein the reaction chamber is a linear ion trap, and the transport pipe includes an injection portion having a plurality of injection ports that injects the radicals in a direction non-orthogonal to a flight direction of ions in the linear ion trap.

In the ion analyzer of the sixth aspect, since radicals are irradiated from the injection portion provided in the transport pipe in a direction non-orthogonal to the flight direction of the ions, more radicals can be irradiated to the ions flying in the linear ion trap.

An ion analyzer according to a seventh aspect of the invention is the ion analyzer according to any one of the first to sixth aspects, wherein the radical generation unit includes a radio-frequency plasma source.

In the ion analyzer of the seventh aspect, radicals are generated using a radio-frequency plasma source. The radio-frequency plasma source generates plasma by vacuum discharge, and it is not necessary to provide an atmospheric pressure space in the ion analyzer. Radicals can be generated from various kinds of first material gases including water vapor and air which are easy to handle.

An ion analyzer according to an eighth aspect of the invention is the ion analyzer according to the seventh aspect, wherein the radio-frequency plasma source is an inductively coupled radio-frequency plasma source.

In the ion analyzer of the eighth aspect, an inductively coupled radio-frequency plasma source is used. In the inductively coupled radio-frequency plasma source, since a higher radical density than that of the capacitively coupled radio-frequency plasma source can be realized, a large amount of radicals can be introduced into the ion trap, and the reaction time can be shortened.

An ion analyzer according to a ninth aspect of the invention is the ion analyzer according to any one of the first to eighth aspects, wherein the radical generation unit and the metastable particle generation unit are common.

In the ion analyzer of the ninth aspect, the configuration of the device can be simplified by using a common radical generation unit and common metastable particle generation unit.

An ion analyzer according to a tenth aspect of the invention is the ion analyzer according to any one of the first to ninth aspects, wherein the first material gas and the second material gas are the same kind of gas.

In the ion analyzer of the tenth aspect, by using the same kind of gas as the first material gas and the second material gas, only one gas supply source may be used, so that the configuration of the device can be simplified.

REFERENCE SIGNS LIST

1 . . . Ion Source
2 . . . Ion Trap
21 . . . Ring Electrode
22 . . . Inlet-Side End Cap Electrode
23 . . . Ion Introduction Hole
24 . . . Outlet-Side End Cap Electrode
25 . . . Ion Ejection Hole
26 . . . Radical Particle Introduction Port
27 . . . Radical Particle Discharge Port
3 . . . Time-Of-Flight Mass Separation Unit
4 . . . Ion Detector
5 . . . Radical Generation/Irradiation Unit
51 . . . Radical Generation Chamber
52 . . . First Material Gas Supply Source
53 . . . Radio-Frequency Plasma Source
531 . . . Microwave Supply Source
532 . . . Three Stub Tuner
54 . . . Nozzle
541 . . . Ground Electrode
542 . . . Torch
543 . . . Needle Electrode
544 . . . Connector
55 . . . Skimmer
56 . . . Valve
58 . . . Transport Pipe
581 . . . Head Part
62 . . . Second Material Gas Supply Source
66 . . . Valve
7 . . . Inert Gas Supply Unit
71 . . . Inert Gas Supply Source
72 . . . Valve
74 . . . Trap Voltage Generation Unit
75 . . . Device Control Unit
80 . . . Ionization Chamber
81 . . . First Intermediate Vacuum Chamber
811 . . . Ion Guide
82 . . . Second Intermediate Vacuum Chamber
821 . . . Ion Guide
83 . . . Analysis Chamber
831 . . . Front-Stage Quadrupole Mass Filter
832 . . . Collision Cell
833. . . . Multipole Ion Guide
834. . . . Rear-Stage Quadrupole Mass Filter
835 . . . Ion Detector
9 . . . Control and Processing Unit
C . . . Ion Optical Axis

The invention claimed is:

1. An ion analyzer that generates and analyzes product ions by irradiating precursor ions derived from a sample component with radicals, the ion analyzer comprising:

a reaction chamber into which the precursor ions are introduced;

a radical generation unit configured to generate radicals from a first material gas;

a metastable particle generation unit configured to generate metastable particles from a second material gas;

a radical introduction unit configured to mix the radical and the metastable particles and introduce the mixture into the reaction chamber; and an ion detection unit configured to detect product ions generated from the precursor ions by a reaction with the radicals.

2. The ion analyzer according to claim 1, wherein the second material gas is a rare gas or a nitrogen gas.

3. The ion analyzer according to claim 1, wherein the radical introduction unit includes a transport pipe that transports a mixture of the metastable particles and the radicals to the reaction chamber.

4. The ion analyzer according to claim 3, wherein an inner diameter of the transport pipe is 5 mm or less.

5. The ion analyzer according to claim 3, wherein the transport pipe is an insulating pipe.

6. The ion analyzer according to claim 3, wherein the reaction chamber is a linear ion trap, and the transport pipe includes an injection portion having a plurality of injection ports that injects the radicals in a direction non-orthogonal to a flight direction of ions in the linear ion trap.

7. The ion analyzer according to claim 1, wherein the radical generation unit includes a radio-frequency plasma source.

8. The ion analyzer according to claim 7, wherein the radio-frequency plasma source is an inductively coupled radio-frequency plasma source.

9. The ion analyzer according to claim 1, wherein the radical generation unit and the metastable particle generation unit are common.

10. The ion analyzer according to claim 1, wherein the first material gas and the second material gas are common.

* * * * *